US005444467A

United States Patent [19]

Stortz

[11] Patent Number: 5,444,467

[45] Date of Patent: Aug. 22, 1995

[54] DIFFERENTIAL DRIVE SYSTEM FOR AN INK JET PRINTHEAD

[75] Inventor: James L. Stortz, Spring, Tex.

[73] Assignee: Compaq Computer Corporation, Houston, Tex.

[21] Appl. No.: 60,296

[22] Filed: May 10, 1993

[51] Int. Cl.[6] ..... B41J 2/045

[52] U.S. Cl. ..... 347/12; 347/71

[58] Field of Search ..... 346/1.1, 140 R; 347/9, 347/11-13, 40, 42, 43, 68, 69, 71; 310/317, 333

[56] References Cited

U.S. PATENT DOCUMENTS

| | | | |
|---|---|---|---|
| 3,857,049 | 12/1974 | Zoltan | 310/8.1 |
| 4,513,299 | 4/1985 | Lee et al. | 346/140 R |
| 4,523,200 | 6/1985 | Howkins | 346/1.1 |
| 4,523,201 | 6/1985 | Liker | 346/1.1 |
| 4,536,097 | 8/1985 | Nilsson | 400/126 |
| 4,584,590 | 4/1986 | Fischbeck et al. | 346/140 R |
| 4,675,693 | 6/1987 | Yano et al. | 346/1.1 |
| 4,743,924 | 5/1988 | Scardovi | 346/140 R |
| 4,752,790 | 6/1988 | Scardovi | 346/140 R |
| 4,825,227 | 4/1989 | Fischbeck et al. | 346/1.1 |
| 4,879,568 | 11/1989 | Bartky et al. | 346/140 R |
| 4,887,100 | 12/1989 | Michaelis et al. | 346/140 R |
| 4,931,810 | 6/1990 | Iwata et al. | 346/1.1 |
| 4,963,882 | 10/1990 | Hickman | 346/1.1 |
| 5,016,028 | 5/1991 | Temple | 346/140 R |
| 5,028,936 | 7/1991 | Bartky | 346/140 |
| 5,138,333 | 8/1992 | Bartky et al. | 346/1.1 |
| 5,235,352 | 8/1993 | Pies et al. | 346/140 R |
| 5,270,740 | 12/1993 | Naruse et al. | 346/140 R |

FOREIGN PATENT DOCUMENTS

| | | | |
|---|---|---|---|
| 0083076 | 7/1983 | European Pat. Off. . | |
| 0278590 | 8/1988 | European Pat. Off. . | |
| 0364136 | 4/1990 | European Pat. Off. . | |
| 0402172 | 12/1990 | European Pat. Off. . | |
| 0485241 | 5/1992 | European Pat. Off. . | |
| 0513971 | 11/1992 | European Pat. Off. . | |
| 0528649 | 2/1993 | European Pat. Off. . | |
| 3820082 | 12/1988 | Germany . | |
| 1-237146 | 9/1989 | Japan | 347/43 |

OTHER PUBLICATIONS

Patent Abstracts of Japan, vol. 12, No. 73, Mar., 1988.

Ream, G. L., entitled "Multiplex Drivers for a Drop-on-Demand Print Head", *IBM Technical Disclosure Bulletin,* vol. 25, No. 11A, pp. 5652-5655 (Apr., 1983).

Wallace, David B., entitled "A Method of Characteristic Model of a Drop-on-Demand Ink-Jet Device Using an Integral Method Drop Formation Model", 89-WA/-FE-4 (1989).

Tsao, C. S., entitled "Drop-on-Demand Ink Jet Nozzle Array with Two Nozzles/Piezoelectric Crystal", *IBM Technical Disclosure Bulletin,* vol. 23 No. 10 (Mar. 1981).

*Primary Examiner*—Benjamin R. Fuller
*Assistant Examiner*—Alrick Bobb
*Attorney, Agent, or Firm*—Konneker & Bush

[57] ABSTRACT

A differential drive system is used to actuate an ink jet printhead having a spaced, parallel series of internal ink receiving channels opening outwardly through ink discharge orifices formed in the printhead body. The channels are laterally bounded by a spaced series of piezoelectrically deflectable internal sidewall actuator sections of the printhead body interdigitated with the channels. The printhead body is specially configured to facilitate wiring access to spaced apart first and second electrical connection portions on each of the actuators. Electrical leads from a first controller are connected to the first actuator portions and are ganged in groups that are selectively connected to a driving voltage source, or to ground, by the first controller. A second controller has a first set of electrical leads similarly ganged in groups and connected to a first set of the second actuator portions, and a second set of unganged electrical leads individually connected to the rest of the second actuator portions. The second controller is operative to selectively connect any of its individual leads, or any of its ganged lead groups, to the driving voltage source or to ground. In conjunction with the dual controllers, this combination of ganged and individually addressable leads connected to the first and second actuator portions permits the actuators to be differentially driven in a manner digitally synthesizing a more complex bipolar drive system.

15 Claims, 4 Drawing Sheets

DIFFERENTIAL DRIVE SYSTEM FOR AN INK JET PRINTHEAD

CROSS REFERENCE TO RELATED APPLICATIONS

This application is related to the following co-pending U.S. patent applications:

| Ser. No. | First Named Inventor | Title |
|---|---|---|
| 08/060,440 | Stortz | Spot Size Modulatable Ink Jet Printhead |
| 08/060,295 | Stortz | Switched Digital Drive System For An Ink Jet Printhead |
| 08/060,294 | Wallace | Droplet Volume Modulation Techniques For Ink Jet Printheads |
| 08/060297 | Stortz | Dual Element Switched Digital Drive System For An Ink Jet Printhead |
| 08/060,298 | Williamson | Three Element Switched Digital Drive System For An Ink Jet Printhead |

All of the above listed applications were filed on even date herewith, assigned to the Assignee of the present invention, and are hereby incorporated by reference as if reproduced in their entirety.

BACKGROUND OF THE INVENTION

1. Field of the Invention

The present invention generally relates to ink jet printhead apparatus and more particularly relates to systems for piezoelectrically driving an ink jet printhead.

2. Description of Related Art

A piezoelectrically actuated ink jet printhead is a relatively small device used to selectively eject tiny ink droplets onto a paper sheet operatively fed through a printer, in which the printhead is incorporated, to thereby form from the ejected ink droplets selected text and/or graphics on the sheet. In one representative configuration thereof, an ink jet printhead has a horizontally spaced parallel array of internal ink-receiving channels. These internal channels are covered at their front ends by a plate member through which a spaced series of small ink discharge orifices are formed. Each channel opens outwardly through a different one of the spaced orifices.

A spaced series of internal piezoelectric wall portions of the printhead body separate and laterally bound the channels along their lengths. To eject an ink droplet through a selected one of the discharge orifices, the two printhead sidewall portions that laterally bound the channel associated with the selected orifice are piezoelectrically deflected into the channel and then returned to their normal undeflected positions. The driven inward deflection of the opposite channel wall portions increases the pressure of the ink within the channel sufficiently to force a small quantity of ink, in droplet form, outwardly through the discharge orifice.

According to a recently proposed drive method for this type of ink jet printhead, top sides of the internal channel dividing wall portions are commonly connected to ground, and the bottom sides of the wall portions are individually connected to a series of electrical actuating leads. Each of these leads, in turn, is connected to a drive control system operable to selectively impart to the lead a wave form that sequentially changes (1) from ground to a first driving polarity, (2) from the first polarity to the opposite polarity, and (3) from the opposite polarity back to ground.

When this electrical wave form is imparted to a piezoelectric wall portion bounding one side of a selected, and a second analog electrical wave form of opposite polarity sequence is simultaneously imparted (via another one of the actuating leads) to the opposite channel wall portion, the opposite channel wall portions, by piezoelectrical action, are sequentially deflected (1) outwardly away from the channel that they laterally bound, (2) into the channel to discharge an ink droplet therefrom, and (3) back to their starting or "neutral" positions.

While the drive system just described provides its printhead with satisfactory printing performance, it has several built-in limitations and disadvantages. For example, the system requires three separate drivers—one for each of the three channel wall drive portions described above. This requirement substantially increases the complexity of the drive system, thereby undesirably increasing its overall cost. Additionally, it undesirably increases the overall space requirement for the drive system.

It can be readily seen from the foregoing that it would be desirable to provide an improved ink jet printhead drive system that eliminates, or at least substantially reduces, the above-mentioned limitations and disadvantages associated with the drive system described above. It is accordingly an object of the present invention to provide such an improved ink jet printhead drive system.

SUMMARY OF THE INVENTION

In carrying out principles of the present invention, in accordance with a preferred embodiment thereof, an ink jet printhead is provided with a specially designed body configuration and a dual controller drive system for operatively actuating the printhead.

The printhead body has a front end section with a spaced series of ink discharge orifices extending rearwardly therethrough. A spaced, parallel series of internal, piezoelectrically deflectable sidewall sections extend rearwardly through the body from the front end section thereof and are interdigitated with and laterally bound opposite sides of a spaced series of internal ink receiving channels that open outwardly through the orifices. Behind its front end section, the printhead body is formed from intersecured top, vertically intermediate and bottom sections.

The top and vertically intermediate sections of the body meet along a first juncture area, and the vertically intermediate section has an exposed top side surface that extends rearwardly beyond the top section. The vertically intermediate section and the bottom section meet along a second juncture area, and the bottom section has an exposed top side surface that extends rearwardly beyond the vertically intermediate section.

The internal sidewall sections of the printhead body have first electrical connection portions extending generally along the first body juncture area, and second electrical connection portions positioned downwardly apart from the first electrical connection portions and extending generally along the second body juncture area. In response to an electrical current flow in opposite directions therethrough between their first and second electrical connection portions, the sidewall sections are piezoelectrically deflectable in laterally opposite directions to cause a selected one or more of the channels to forwardly discharge a quantity of ink disposed therein, in droplet form, through the printhead body through its orificed front end section.

A first series of electrically conductive surface traces extend along the exposed top side surface area of the vertically intermediate body section and are connected at ends thereof to the first sidewall section electrical connection portions. In a similar manner, a second series of electrically conductive surface traces extend along the exposed top side surface area of the bottom body section and are connected at ends thereof to the second sidewall section electrical connection portions.

The first series of electrically conductive surface traces are ganged into first lead sets that are coupled to first controller means operative to couple a selectively variable one or more of the first lead sets to a driving voltage of a predetermined polarity of to connect each selected lead set to ground. A portion of the second series of electrically conductive surface traces are ganged into second lead sets, with the rest of these traces being unganged. The second series of electrical traces are coupled to second controller means operative to couple a selectively variable one or more of the second lead sets, or the unganged leads, to a driving voltage of said predetermined polarity or to ground.

To actuate a selected channel in a manner operatively discharging ink therefrom, the first and second controller means are operated in a manner imposing opposite voltage differentials on the two side wall sections positioned on opposite sides of the selected channel to cause the two sidewall sections to simultaneously deflect into the channel.

The surface traces are grouped into the above mentioned ganged and unganged arrays in a manner such that any selected one or more of the channels may be actuated using a total number of controller means output signals substantially less than the total number of the first and second sidewall section electrical connection portions. In conjunction with the dual controllers, this combination of ganged and individually addressable leads connected to the sidewall actuators permits the actuators to be differentially driven in a manner digitally synthesizing a more complex bipolar drive system.

DETAILED DESCRIPTION

Figure 1:
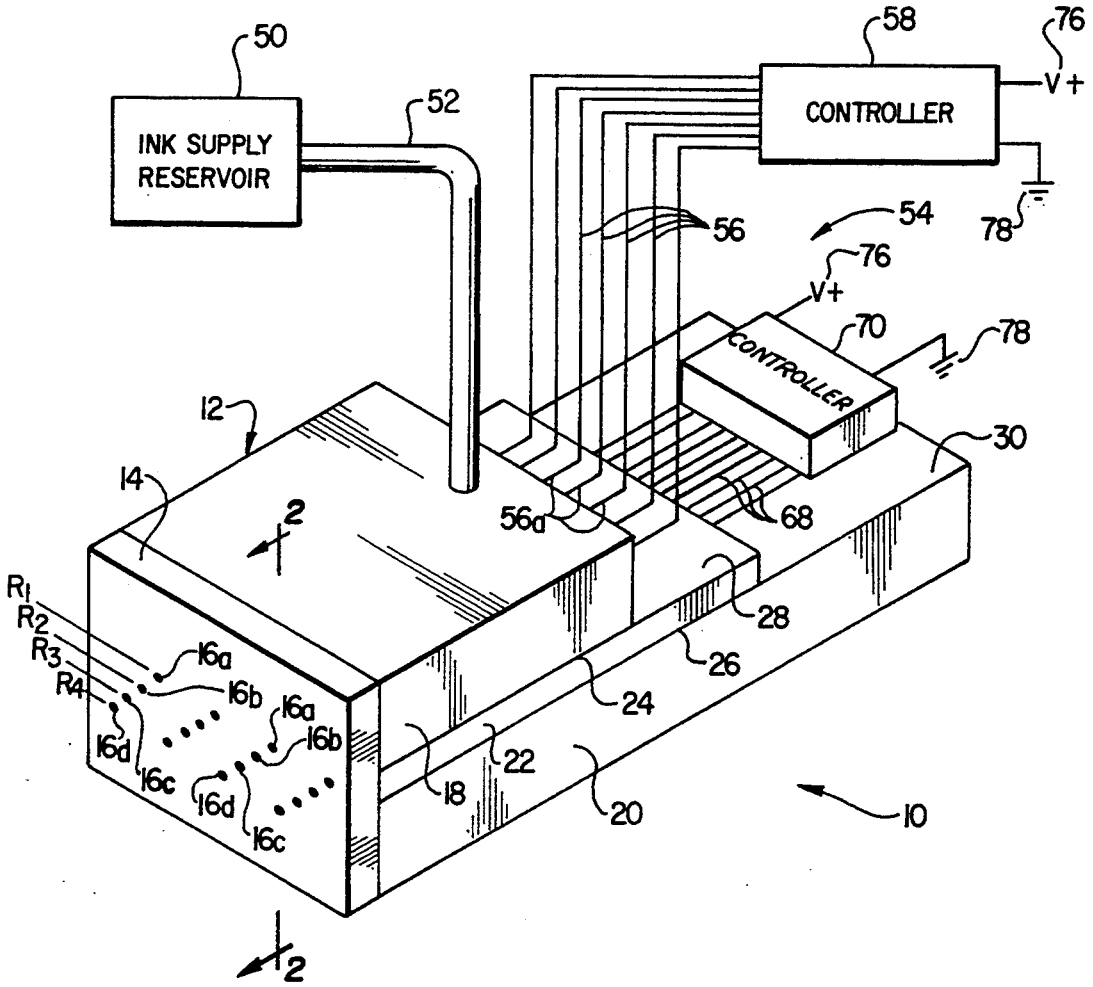
FIG. 1 is a simplified, somewhat schematic perspective view of an ink jet printhead incorporating therein a specially designed differential drive system embodying principles of the present invention.

Referring initially to FIG. 1, the present invention provides an ink jet printhead 10 having a specially configured printhead body 12. A left or front end section of the body 12 is defined by a horizontally elongated rectangular orifice plate 14 that is preferably formed from a nonpiezoelectric ceramic material. Extending rearwardly through the plate 14 are a horizontally spaced series of small ink discharge orifices 16. As illustrated, the orifices 16 are grouped in horizontally successive, vertically sloped sets of four orifices **16*a*–16*d*, with the orifices 16*a*–16*d*** cumulatively forming four vertically spaced horizontal rows $R_1$–$R_4$ of orifices.

Secured to the rear side of the orifice plate 14, and extending rearwardly therefrom, are three intersecured body sections, each of a rectangular configuration, a top section 18, a bottom section 20, and a vertically intermediate section 22 sandwiched between the top and bottom sections. Sections 18 and 22 meet along a side surface juncture area 24, while sections 20 and 22 meet along a side surface juncture area 26.

Figure 2A:
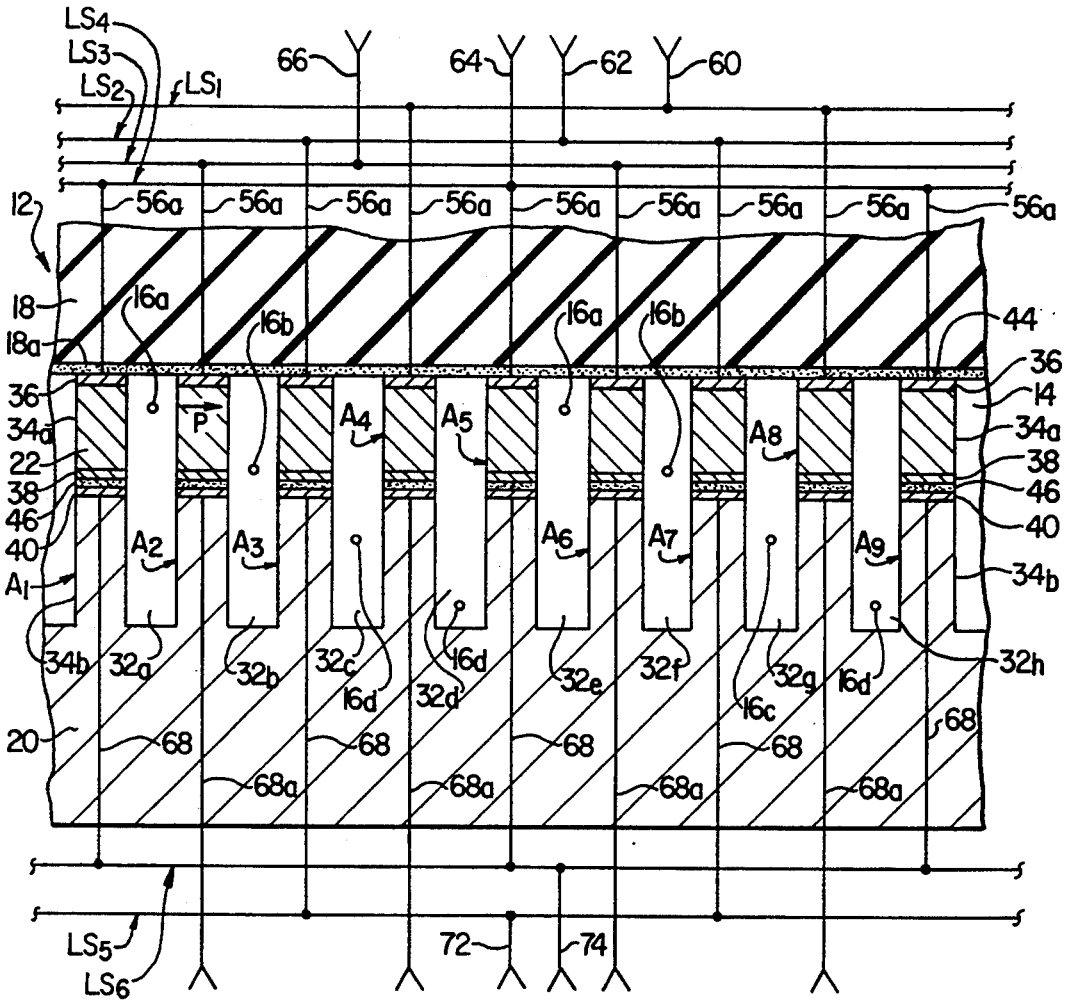
FIG. 2A is an enlarged scale partial cross-sectional view through the printhead taken along line 2—2 of FIG. 1 and schematically illustrating the ganged electrical connection between controller and sidewall actuator portions of the printhead.

The top and bottom body sections 18 and 20 are preferably formed from a nonpolled ceramic material, and the vertically intermediate body section 22 is formed a piezoelectrically active ceramic material polled in the direction "P" indicated in FIG. 2A. For purposes later described, the vertically intermediate body section 22 extends rearwardly beyond the top section 18 and has an exposed top side surface area 28 extending rearwardly from the back end of the juncture area 24. In a similar fashion, the bottom body section 20 extends rearwardly beyond the vertically intermediate section 22 and has an exposed top side surface area 30 extending rearwardly from the back end of the juncture area 26.

Turning now to FIG. 2A, a plurality of vertical grooves of predetermined width and depth are formed in the printhead body sections 20 and 22 to define within the printhead body 12 a spaced, parallel series of internal ink receiving channels 32 that longitudinally extend rearwardly from the orifice plate 14, with the front end of each of the channels opening outwardly through one of the ink discharge orifices 16. A representative group of channels **32*a*–32*h*** is shown in the printhead body portion cross-sectionally depicted in FIG. 2A.

The channels 32 are laterally bounded along their lengths by opposed pairs of a series of internal actuator sidewall sections A of the printhead body interdigitated with the channels. A representative group of sidewall actuator sections $A_1$–$A_9$ are shown in the printhead body portion cross-sectionally depicted in FIG. 2A.

The sidewall sections A have upper parts **34*a* defined by horizontally separated vertical portions of the body section 22, and lower parts 34*b* defined by horizontally separated portions of the body section 20. The top and bottom sides of the actuator sidewall section parts 34*a*, and the top sides of the actuator sidewall section parts 34*b* are respectively coated with electrically conductive metal layers 36, 38 and 40. Body sections 18 and 22 are secured to one another by a layer of an insulative adhesive material 44 positioned between lower side surface 18*a* of the body section 18 and the conductive metal layer 36. Body sections 20 and 22, on the other hand, are secured to one another by a layer of electrically conductive adhesive material 46 positioned between the metal layers 38 and 40**.

The illustrated layer groups of metal and electrically conductive adhesive form vertically separated top and bottom electrical connection portions on each of the actuators A. The top electrical connection portions defined by the metal layers 36 are arrayed generally along the body section juncture area 24, and the bottom electrical connection portions (defined by the metal layers 38,40 and the adhesive layers 46) are arrayed generally along the body section juncture area 26.

Each of the channels 32 is filled with ink received from a suitable ink supply reservoir 50 (see FIG. 1) connected to the channels via an ink delivery conduit 52 communicating with the channels via an ink supply manifold cavity (not shown) disposed within the printhead body 12 and coupled to rear end portions of the internal channels 32.

Figure 2B:
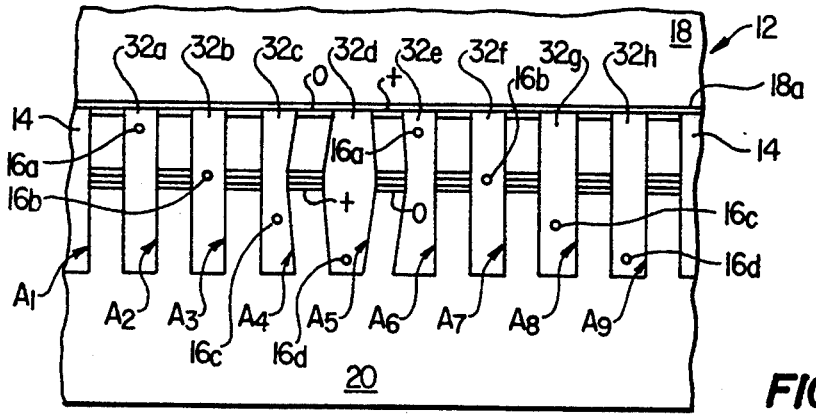
FIGS. 2B–2D are enlarged scale simplified partial cross-sectional views taken through the printhead along line 2—2 of FIG. 1 and illustrating a drive method by which a channel is actuated by a pair of sidewall actuators portions laterally bounding the actuated channel.

In a manner subsequently described, each horizontally opposed pair of the actuators A are piezoelectrically deflectable into the channel 32 that they laterally bound to force a quantity of ink disposed in the channel outwardly, in droplet form, through its associated orifice. For example, to discharge an ink droplet from the orifice **16*d* associated with channel 32*d*, the opposing actuator sidewall sections $A_4$ and $A_5$ are each deflected outwardly, relative to the channel 32*d*, from a rest position as illustrated in FIG. 2A to an expansion position illustrated in FIG. 2B by simultaneously applying a positive voltage to the bottom electrical connection portion of actuator sidewall section $A_4$ and to the top electrical connection portion of actuator sidewall section $A_5$ while holding the top electrical connection portion of actuator sidewall section $A_4$ and the bottom electrical connection portion of actuator sidewall section $A_5$ to ground. Deflection of the actuator sidewall sections $A_4$ and $A_5$ into the illustrated expansion position causes the generation of a pressure pulse which propagates both forwardly and rearwardly within the channel 32*d*. The actuator sidewall sections $A_4$ and $A_5$ are then held in the outwardly deflected position illustrated in FIG. 2B to allow the rearwardly propagating portion of the generated pressure pulse to reflect off a rear wall (not shown) of the ink jet printhead 10** as a forwardly propagating pressure pulse and to travel back to its initial position.

Figure 2C:
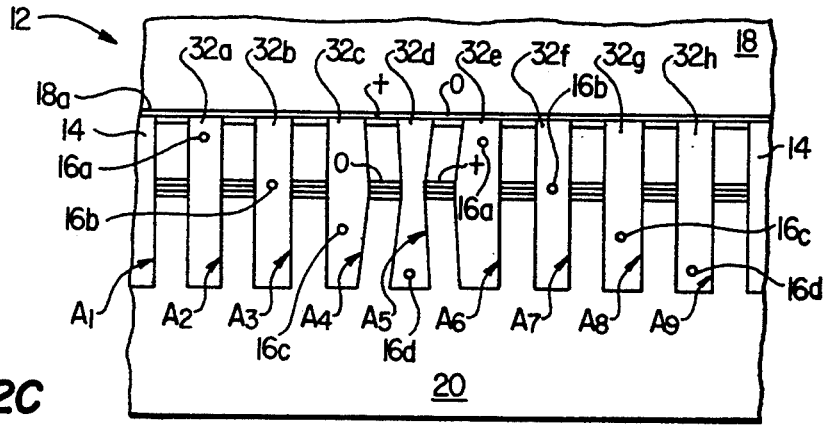
Figure 2D:
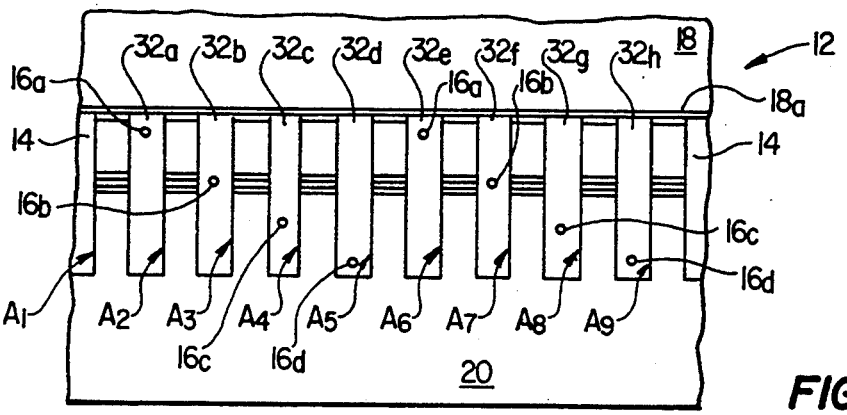

The actuator sidewall sections $A_4$ and $A_5$ are then deflected inwardly, relative to the channel **32*d*, as illustrated in FIG. 2C, by removing the positive voltage applied to the bottom electrical connection portion of actuator sidewall section $A_4$ and to the top electrical connection portion of actuator sidewall section $A_5$ and holding the aforementioned electrical connection portions to ground while applying a positive voltage to the top electrical connection portion of actuator sidewall section $A_4$ and to the bottom electrical connection portion of actuator sidewall section $A_5$ which previously had been held to ground. Deflection of the actuator sidewall sections $A_4$ and $A_5$ into the illustrated contraction position causes the generation of a second pressure pulse which reinforces the forwardly propagating pressure pulse reflected off the rear wall of the ink jet printhead 10. The actuator sidewall sections $A_4$ and $A_5$ are then held in the inwardly deflected position illustrated in FIG. 2C while the droplet forming, forwardly propagating pressure pulse propagates towards the orifice 16*d*. The actuator sidewall sections $A_4$ and $A_5$ are then returned to the rest position, as illustrated in FIG. 2D**, to terminate formation of the droplet by removing the positive voltage applied to the top electrical connection portion of actuator sidewall section $A_4$ and to the bottom electrical connection portion of actuator sidewall section $A_5$.

The actuators A and their associated channels 32 are relatively configured in a manner such that an inward deflection of only one of a given channel's opposed actuator sections into the channel does not cause ink to be ejected from the channel. Both of the opposed actuator sidewall sections have to be simultaneously deflected into the channel therebetween to create operative ink droplet discharge from the channel.

Referring now to FIGS. 1 and 2A, the operative piezoelectric deflection of the actuator sidewall sections A is effected by a specially designed differential drive system 54 embodying principles of the present invention. Drive system 54 includes a spaced series of electrical leads 56 having first end portions connected to a controller 58. Second end portions of the leads 56 are defined by electrically conductive surface traces **56*a* formed on the exposed top side surface 28 of the printhead body section 18 (see FIG. 1), each of the traces 56*a* being connected to one of the top electrical connection portions of the sidewall actuators A as schematically depicted in FIG. 2A**.

Traces **56*a* are ganged into four lead sets $LS_1$–$LS_4$ which are respectively coupled to controller 58 by leads 60,62,66 and 64. $A_5$ schematically illustrated in FIG. 2A, the four lead sets $LS_1$–$LS_4$ are each connected to every fourth top electrical connection portion in different interdigitated series of the actuator sidewall sections A. For example, in the actuators $A_1$–$A_9$ shown in FIG. 2A**, lead set $LS_1$ is connected to the top electrical connection portions of the actuators $A_4$ and $A_8$; lead set $LS_2$ is connected to the top electrical connection portions of the actuators $A_3$ and $A_7$; lead set $LS_3$ is connected to the top electrical connection portions of the actuators $A_2$ and $A_6$; and lead set $LS_4$ is connected to the top electrical connection portions of actuators $A_1$, $A_5$ and $A_9$.

The differential drive system 54 also includes a spaced series of leads in the form of electrically conductive traces 68 formed on the exposed top side surface 30 of the printhead body section 20 and interconnected between the bottom electrical connection portions of the actuators A and a controller 70 representatively mounted on the top side surface 30.

A first portion of the traces 68 are ganged into two lead sets $LS_5$ and $LS_6$ respectively coupled to controller 70 by leads 72 and 74. As schematically illustrated in FIG. 2A, the lead sets $LS_5$ and $LS_6$ are each connected to every fourth bottom electrical connection portion in different interdigitated series of the actuator sidewall sections A. For example, in the actuators $A_1$–$A_9$ shown in FIG. 2A the lead set $LS_5$ is connected to the bottom electrical connection portions of the actuators $A_3$ and $A_7$, and the lead set $LS_6$ is connected to the actuators $A_1$, $A_5$ and $A_9$.

The remainder of the electrical traces 68, namely traces **68*a*, are individually interconnected between the controller 70 and alternate ones of the bottom electrical connection portions of the actuators A. For example, in the actuators $A_1$–$A_9$ shown in FIG. 2A, the individually addressable leads 68*a*** are separately connected to the bottom electrical connection portions of the alternate actuators $A_2$, $A_4$, $A_6$ and $A_8$.

Via suitable internal circuitry (not shown) the controller 58 is operable to alternately connect any one or more of the leads 60, 62, 64 and 66 (and thus any one or more of the lead sets $LS_1$–$LS_4$) to a positive driving voltage source 76 or to ground 78. In a similar manner, controller 70 is operative to alternately connect either or both of the leads 72,74 (and thus either or both of the lead sets $LS_5$ and $LS_6$) to the voltage source 76 or to ground 78.

Accordingly, the controllers 58 and 70 may be utilized to create a current flow in either vertical direction between the top and bottom electrical connection portions of selected ones of the actuators A to thereby actuate selectively variable ones of the channels 32 by piezoelectrically causing the deflection of the opposing actuators A which laterally bound them in the manner previously described.

For example, if it is desired to actuate the channels **32*a* and 32*e*, as shown in FIG. 2A, the controller 58 is operated to connect the lead 64 to positive voltage source 76 and the lead 66 to ground while the controller 70 is operated to connect the lead 74 to ground, and couple to the positive voltage source 78 the two individual leads 68*a* connected to the bottom electrical connection portions of the actuators $A_2$ and $A_6$. This creates a positive voltage on the top electrical connection portions of actuators $A_1$ and $A_5$ and on the bottom electrical connection portions of actuators $A_2$ and $A_6$, and grounds the bottom electrical connection portions of actuators $A_1$ and $A_5$ and the top electrical connection portions of actuators $A_2$ and $A_6$. The resulting electrical current flows through the top parts 22 of actuators $A_1$–$A_2$ and $A_5$–$A_6$ causes the actuator pairs $A_1$,$A_2$ and $A_5$,$A_6$ to respectively deflect outwardly relative to the channels 32*a* and 32*e*. The aforementioned voltages are then reversed, either from positive to ground or from ground to positive, to cause the actuator pairs $A_1$,$A_2$ and $A_5$,$A_6$ to respectively deflect inwardly relative to the channels 32*a* and 32*e* to actuate the channels. With the remaining individual leads 68*a* neither connected to ground nor to the positive voltage source by the controller 70**, it can be seen that no other facing pair of actuators are both deflected into the channel therebetween. Accordingly, no other channels are actuated.

As another example of the operation of the differential drive system 54, all of the channels 32 associated with the orifices 16 in any of the four orifice rows $R_1$–$R_4$ may be simultaneously actuated if desired as schematically indicated in FIGS. 3A–3D. For example, to simultaneously "fire" all of the orifices **16*a* in the top orifice row $R_1$, the controllers 58,70 are operated to first positively charge and ground the top and bottom electrical connection portions of the opposing pairs of actuators bounding the channels associated with the orifices 16*a*** in a manner causing such opposing actuator pairs to deflect outwardly away from their channels and then reverse the aforementioned positive charges and grounds to cause the opposing actuator pairs to deflect inwardly into the channels to force the ejection of a droplet of ink therefrom.

Figure 3A:
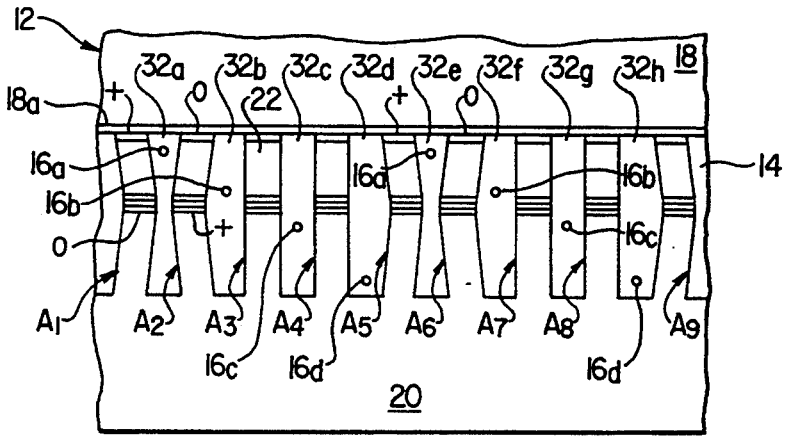
FIGS. 3A–3D are enlarged scale simplified partial cross-sectional views taken through the printhead along line 2—2 of FIG. 1 and sequentially illustrating a representative manner in which the controller portions of the printhead may be utilized to differentially drive selected sidewall actuator portions thereof.

With respect to the actuators $A_1$–$A_9$ illustrated in FIG. 3A, the various ganged lead sets and individually addressable leads are first connected to the positive voltage source or to ground in a manner imposing a positive voltage "+" on the top electrical connection portions of the actuators $A_2$ and $A_6$ and on the bottom electrical connection portions of the actuators $A_1$ and $A_5$, and grounding (as indicated by the symbol "0") the top electrical connection portions of the actuators $A_1$ and $A_5$ and the bottom electrical connection portions of the actuators $A_2$ and $A_6$. The connections are then reversed so that the positive voltage "+" is imposed on the top electrical connection portions of the actuators $A_1$ and $A_5$ and on the bottom electrical connection portions of the actuators $A_2$ and $A_6$, and the top electrical connection portions of the actuators $A_2$ and $A_6$ and the bottom electrical connection portions of the actuators $A_1$ and $A_5$ are grounded as illustrated in FIG. 3A.

Figure 3B:
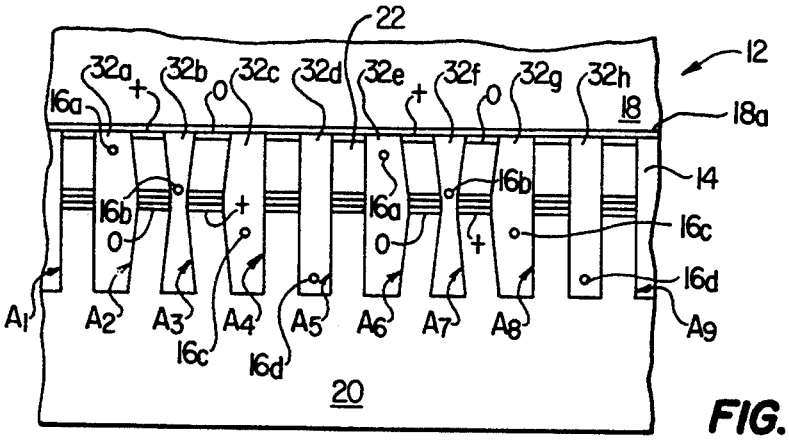
Figure 3C:
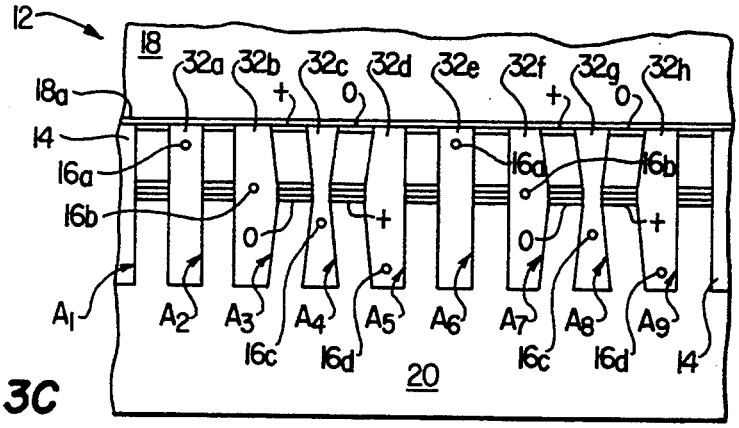
Figure 3D:
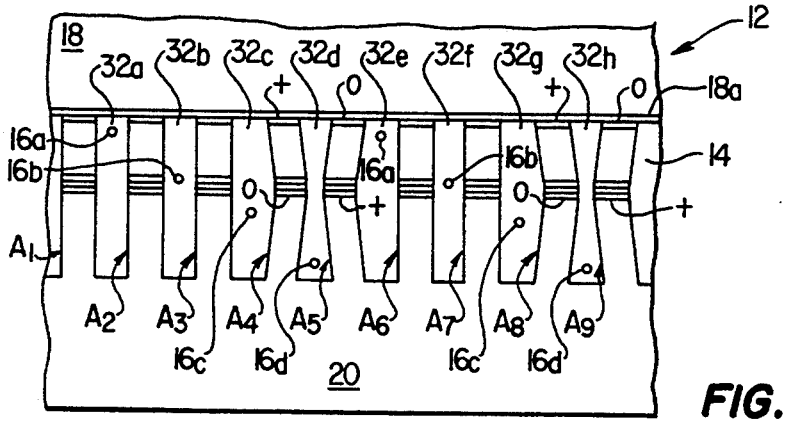

Importantly, the described combination of ganged lead sets and individually addressable leads permits the controllers 58,70 to fire individual orifice rows without firing any of the orifices of the other orifice rows. FIGS. 3B–3D illustrate, with the symbols "+" and "0", the positive charge and grounding connections obtainable by the controllers 58,70 on the indicated actuators A during the inward deflection portion of the drive method to respectively fire the orifice rows $R_2$–$R_4$.

The illustrated four orifice stagger, and corresponding combination of ganged lead sets and individually addressable leads, shown and described herein is merely illustrative, and other orifice stagger arrangements (for example, a three orifice stagger) and corresponding arrangements of ganged lead sets and individually addressable leads could alternatively be utilized if desired.

The differential printhead piezoelectric drive scheme just described is significantly facilitated by the unique configuration of the printhead body which, via the two exposed top side surface areas 28 and 30 of the printhead body, allows direct wiring access to the body section juncture areas 24,26 and thus to the top and bottom electrical connection portions of each of the internal sidewall actuators A. Compared to drive systems which require drive control structure configured to actively drive electrical actuating leads associated therewith between three states-positive, negative and ground, the digital drive system 54 of the present invention requires drive control structure configured to actively drive electrical actuating leads associated therewith between only two states-positive and ground. Accordingly, the controllers 58, 70 of the digital drive system 54 are considerably less complex and expensive, and require appreciably less space than those contemplated for use in other drive systems.

The foregoing detailed description is to be clearly understood as being given by way of illustration and example only, the spirit and scope of the present invention being limited solely by the appended claims.

What is claimed is:

1. An ink jet printhead comprising:

a body having a front end section with a spaced series of ink discharge orifices extending rearwardly therethrough, said body further having a spaced, parallel series of internal sidewall sections extending rearwardly through said body from said front end section thereof and laterally bounding a spaced series of internal ink receiving channels interdigitated with said sidewall sections and opening outwardly through said discharge orifices, each of said sidewall sections having thereon spaced apart first and second electrical connection portions between which electrical current may be flowed in selectively opposite directions through selected ones of said sidewall sections to piezoelectrically deflect said selected ones of said sidewall sections in correspondingly opposite directions, said first electrical connection portions of said sidewall sections arranged in one or more separate groups of first electrical connection portions, a first portion of said second electrical connection portions of said sidewall sections arranged in one or more separate groups of second electrical connection portions and a remaining portion of said second electrical connection portions of said sidewall sections arranged as one or more individual second electrical connection portions; and drive means for piezoelectrically actuating a selected one or more of said channels in a manner causing a quantity of ink disposed in each one of said selected channels to be ejected through each of said discharge orifices associated with one of said selected channels, said drive means being operative to:

(1) commonly and selectively impose a driving voltage of a predetermined polarity on, or connect to ground, selected ones of said one or more separate groups of first electrical connection portions, (2) commonly and selectively impose a driving voltage of said predetermined polarity on, or connect to ground, selected ones of said one or more separate groups of second electrical connection portions, and (3) individually and selectively impose a driving voltage of said predetermined polarity on, or connect to ground, selected ones of said one or more individual second electrical connection portions of said sidewall sections.

2. An ink jet printhead comprising:

a body having a front end section with a spaced series of ink discharge orifices extending rearwardly therethrough, said body further having a spaced, parallel series of internal sidewall sections extending rearwardly through said body from said front end section thereof and laterally bounding a spaced series of internal ink receiving channels interdigitated with said sidewall sections and opening outwardly through said discharge orifices, each of said sidewall sections having thereon spaced apart first and second electrical connection portions between which electrical current may be flowed in selectively opposite directions through selected ones of said sidewall sections to piezoelectrically deflect said selected ones of said sidewall sections in correspondingly opposite directions, said first electrical connection portions of said sidewall sections arranged in one or more separate groups of first electrical connection portions and a portion of said second electrical connection portions of said sidewall sections arranged in one or more separate groups of second electrical connection portions; and drive means for piezoelectrically actuating a selected one or more of said channels in a manner causing a quantity of ink disposed in each one of said selected channels to be ejected through each of said discharge orifices associated with one of said selected channels, said drive means including:

a first series of electrical leads connected in first ganged lead sets to said groups of said first electrical connection portions, a second series of electrical leads divided into second ganged lead sets connected to said groups of said second electrical connection portions, and a series of individual, unganged leads connected to said remaining portion of said second electrical connection portions, first controller means for alternately coupling a selected one or more of said first lead sets to a driving voltage source of said predetermined polarity or to ground, and second controller means for alternately coupling a selected one or more of said second lead sets and said individual, unganged leads to a driving voltage source of said predetermined polarity or to ground, said drive means being operative to:

(1) commonly and selectively impose a driving voltage of a predetermined polarity on, or connect to ground, Selected ones of said one or more separate groups of first electrical connection portions, (2) commonly and selectively impose a driving voltage of said predetermined polarity on, or connect to ground, selected ones of said one or more separate groups of second electrical connection portions, and (3) individually and selectively impose a driving voltage of said predetermined polarity on, or connect to ground, a remaining portion of said second electrical connection portions of said sidewall sections.

3. The ink jet printhead of claim 2 wherein:

said body has intersecured top, bottom and vertically intermediate sections extending rearwardly from said front end section of said body, said top section being joined to said vertically intermediate section along a first juncture area, and said vertically intermediate section being joined to said bottom section along a second juncture area, said first electrical connection portions of said sidewall sections are positioned generally along one of said first and second juncture areas, and said second electrical connection portions of said sidewall sections are positioned generally along the other of said first and second juncture areas.

4. The ink jet printhead of claim 3 wherein:

said vertically intermediate section of said body has an exposed first top side surface area extending rearwardly beyond said top section of said body, said bottom section of said body has an exposed second top side surface area extending rearwardly beyond said vertically intermediate section of said body, said first series of electrical leads are partially defined by a spaced series of electrically conductive traces formed on said first top side surface area and operatively connected at ends thereof to the sidewall section electrical connection portions positioned along said first juncture area, and said second series of electrical leads are partially defined by a spaced series of electrically conductive traces formed on said second top side surface area and operatively connected at ends thereof to the sidewall section electrical portions positioned along said second juncture area.

5. The ink jet printhead of claim 1 wherein:

said driving voltages are generally equal DC voltages.

6. The ink jet printhead of claim 5 wherein:

said DC voltages are positive DC voltages.

7. The ink jet printhead of claim 2 wherein:

said ink discharge orifices are disposed on said front end section of said body in an elongated array of orifices mutually spaced apart from one another in a first direction transverse to the length of said channels, with successive groups a four of said orifices being parallel to one another and sloped relative to said first direction, every fourth electrical connection portion in each of a plurality of different spaced series of said first sidewall section electrical connection portions is connected to a different one of said first ganged lead sets, and every fourth electrical connection portion in each of a plurality of different spaced series of said second sidewall section electrical connection portions is connected to a different one of said second ganged lead sets.

8. The ink jet printhead of claim 4 wherein:

said ink discharge orifices are disposed on said front end section of said body in an elongated array of orifices mutually spaced apart from one another in a first direction transverse to a length of said channels, with successive groups of four of said orifices being parallel to one another and sloped relative to said first direction, every fourth electrical connection portion in each of a plurality of different spaced series of said first sidewall section electrical connection portions is connected to a different one of said first ganged lead sets, and every fourth electrical connection portion in each of a plurality of different spaced series of said second sidewall section electrical connection portions is connected to a different one of said second ganged lead sets.

9. An ink jet printhead comprising:

a body having:

a front end section with a spaced series of ink discharge orifices extending rearwardly therethrough, intersecured first, second and third sections each extending rearwardly from said front end section, said first and second sections meeting along a first juncture area, and said second and third sections meeting along a second juncture area, a first exposed side surface area extending along and rearwardly from said first juncture area, a second exposed side surface area extending along and rearwardly from said second juncture area, a spaced, parallel series of internal, piezoelectrically deflectable sidewall sections extending rearwardly through said body from said front end section and laterally bounding a spaced series of internal ink receiving channels interdigitated with said sidewall sections and opening outwardly through said discharge orifices, said sidewall sections having first electrical connection portions extending generally along said first juncture area, and second electrical connection portions extending generally along said second juncture area, a first spaced series of electrically conductive surface traces extending along said first exposed side surface area and connected at ends thereof to said first sidewall section electrical connection portions, and a second spaced series of electrically conductive surface traces extending along said second exposed side surface area and connected at ends thereof to said second sidewall section electrical connection portions; and drive means for piezoelectrically deflecting a selected number of said sidewall sections in a manner causing a quantity of ink disposed in a selected one or more of said channels to be forwardly discharged in droplet form from said body, said drive means including:

first means for selectively imposing a driving voltage on, or grounding, a selectively variable group of said first series of electrically conductive surface traces, and second means for selectively imposing a driving voltage on, or grounding, a selectively variable group of said second series of electrically conductive surface traces.

10. A method of actuating an ink jet printhead having a body with a spaced, parallel series of internal, piezoelectrically deflectable sidewall sections having first and second areas and extending rearwardly through said body, said sidewall sections interdigitated with a spaced series of internal ink receiving channels opening outwardly through a spaced series of ink discharge orifices, said first areas of said sidewall sections arranged into one or more separate groups of first areas, a portion of said second areas of said sidewall sections arranged into one or more separate groups of second areas and a remaining portion of said second areas of said sidewall sections arranged as one or more individual second areas, said method comprising the steps of:

commonly and selectively imposing a driving voltage of a predetermined polarity on, or connecting to ground, selected ones of said one or more separate groups of first areas, commonly and selectively imposing a driving voltage of said predetermined polarity on, or connecting to ground, selected ones of said one or more separate groups of second areas, and individually and selectively imposing a driving voltage of said predetermined polarity on, or connecting to ground, selected ones of said one or more individual second areas of said sidewall sections, said second areas on said sidewall sections being spaced apart from said first areas thereon.

11. A method of actuating an ink jet printhead having a body with a spaced, parallel series of internal, piezoelectrically deflectable sidewall sections having first and second areas and extending rearwardly through said body, said sidewall sections interdigitated with a Spaced series of internal ink receiving channels opening outwardly through a spaced series of ink discharge orifices, said first areas of said sidewall sections arranged into one or more separate groups of first areas and a portion of said second areas of said sidewall sections arranged into one or more separate groups of second areas, said body having first, second and third intersecured sections extending parallel to a length of said channels, with said first and second sections meeting along a first juncture area, and said second and third sections meeting along a second juncture area, said first areas of said sidewall sections positioned generally along said first juncture area, said second areas of said sidewall sections positioned generally along said first juncture area, said method comprising the steps of:

respectively connecting first and second sets of electrical leads to said first and second areas of said sidewall sections generally along said first and second juncture areas:

commonly and selectively imposing a driving voltage of predetermined polarity on, or connecting to ground, selected ones of said one Or more separate groups of first areas;

commonly and selectively imposing a driving voltage of said predetermined polarity on, or connecting to ground, selected ones of said one or more separate groups of second areas; and individually and selectively imposing a driving voltage of said predetermined polarity on, or connecting to ground, remaining ones of said second areas of said sidewall sections said second areas on said sidewall sections being spaced apart from said first areas thereon.

12. The method of claim 11 wherein:

said second section has a first exposed side surface extending along and away from said first juncture area, said third section has a second exposed side surface extending along and away from said second juncture area, said first set of electrical leads are partially defined by a spaced series of first electrically conductive surface traces extending along said first exposed side surface and operatively connected at ends thereof to said first areas of said sidewall sections, said second set of electrical leads are partially defined by a spaced series of second electrically conductive surface traces extending along said second exposed side surface and operatively connected at ends thereof to said second areas of said sidewall sections, and said method further comprises the step of grouping said first and second series of electrically conductive surface traces into ganged and unganged sets thereof, and said imposing steps are performed by selectively imposing a driving voltage on, or connecting to ground, selectively variable ones of the ganged and unganged traces.

13. An ink jet printhead comprising:

a base having a front side and at least four generally parallel elongated liquid confining channels extending therethrough, each one of said channels terminating at said front side, said base Section including:

a base section formed from an inactive material, said base section having a plurality of generally parallel spaced projections extending longitudinally along said base section, each of said projections having a top side;

a cover section formed from an inactive material, said cover section having a bottom side; and a plurality of intermediate sections, each said intermediate section having a top side insulatively mounted to said bottom side of said cover section and a bottom side mounted on said top side of a corresponding one of said plurality of base section projections, each of said intermediate sections formed from an active piezoelectric material;

a cover having a number of apertures formed therein mounted to said front side of said base, said apertures positioned on said cover to define first, second, third and fourth generally parallel aperture rows of at least one aperture each, each one of said apertures in communication with a corresponding one of said channels;

a first controller electrically connected to said top side of each one of said plurality of intermediate sections, said first controller selectively applying either a positive or ground voltage to said top side of selected ones of said plurality of intermediate sections; and a second controller electrically connected to said bottom side of each one of said plurality of intermediate sections, said second controller selectively applying a positive or ground voltage to said bottom side of selected ones of said plurality of intermediate sections.

14. An ink jet printhead according to claim 13 wherein each one of said channels further comprises a lower wall and wherein each of said at least one aperture of said first, second, third and fourth aperture rows are positioned a first, second, third and fourth distance, respectively, above said lower wall of said corresponding one of said channels.

15. An ink let printhead, comprising:

a base section formed from an inactive material, said base section having a plurality of generally parallel spaced projections extending longitudinally along said base section, each of said projections having a top side;

a plurality of intermediate sections formed from an active piezoelectric material, each said intermediate section having a top side and a bottom side mounted to said top side of a corresponding one of said plurality of base section projections;

a cover section formed from an inactive material and having a bottom side, said top side of each of said plurality of intermediate sections insulatively mounted to said bottom side of said cover section;

a first controller electrically connected to said top side of each one of said intermediate sections, said first controller selectively applying either a positive or ground voltage to said top side of selected ones of said plurality of intermediate sections; and a second controller electrically connected to said bottom side of each one of Said intermediate sections, said second controller selectively applying a positive or ground voltage to said bottom side of selected ones of said plurality of intermediate sections.

* * * * *